US009299481B2

(12) United States Patent
Ishikawa et al.

(10) Patent No.: US 9,299,481 B2
(45) Date of Patent: Mar. 29, 2016

(54) DIFFERENTIAL SIGNAL CABLE AND PRODUCTION METHOD THEREFOR

(71) Applicant: Hitachi Metals, Ltd., Tokyo (JP)

(72) Inventors: Hiroshi Ishikawa, Hitachi (JP); Takahiro Sugiyama, Hitachi (JP); Izumi Fukasaku, Hitachi (JP); Hidenori Yonezawa, Hitachi (JP); Masafumi Kaga, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/510,261

(22) Filed: Oct. 9, 2014

(65) Prior Publication Data

US 2015/0162113 A1 Jun. 11, 2015

(30) Foreign Application Priority Data

Dec. 6, 2013 (JP) ..... 2013-253420

(51) Int. Cl.
*H01B 7/30* (2006.01)
*H01B 11/00* (2006.01)
*H01B 11/18* (2006.01)

(52) U.S. Cl.
CPC ..... *H01B 11/002* (2013.01); *H01B 11/1839* (2013.01); *Y10T 29/49123* (2015.01)

(58) Field of Classification Search
CPC ..... H01B 7/30; H01B 11/02
USPC ..... 174/113 R, 117 F
See application file for complete search history.

(56) References Cited

U.S. PATENT DOCUMENTS 5,187,329 A * 2/1993 Bleich ..... H01B 7/361 174/112
5,245,134 A * 9/1993 Vana, Jr. ..... G02B 6/4403 156/47
6,005,193 A * 12/1999 Markel ..... H01B 7/30 174/117 F
6,403,887 B1 * 6/2002 Kebabjian ..... H01B 11/002 174/110 R
8,546,691 B2 10/2013 Watanabe et al.
2013/0175081 A1 7/2013 Watanabe et al.
2013/0319724 A1 12/2013 Watanabe et al.

FOREIGN PATENT DOCUMENTS

JP 2013-157309 A 8/2013

OTHER PUBLICATIONS

C. Paul, "Introduction to Electromagnetic Compatibility," Wiley-Interscience, A John Wiley & Sons, Inc. Publication, Dec. 2005.

* cited by examiner

*Primary Examiner* — Chau N Nguyen
(74) *Attorney, Agent, or Firm* — McGinn IP Law Group, PLLC

(57) ABSTRACT

A differential signal cable is composed of two inner conductors, an insulator, which covers the two inner conductors separately or together, and an outer conductor, which covers a circumference of the insulator. When measured in a cable length of 1 m, an effective capacitance difference ΔX represented by Formula (1) below is not greater than 0.2 percent of an average value C of capacitances of the two inner conductors, $$\Delta X=\Delta C+\Delta L/Z_0^2 \quad (1),$$

where ΔC is a difference in capacitance between the two inner conductors, ΔL is a difference in inductance between the two inner conductors, and $Z_0$ is a reference impedance (50 ohms).

8 Claims, 3 Drawing Sheets

DIFFERENTIAL SIGNAL CABLE AND PRODUCTION METHOD THEREFOR

The present application is based on Japanese patent application No.2013-253420 filed on Dec. 6, 2013, the entire contents of which are incorporated herein by reference.

BACKGROUND OF THE INVENTION

1. Field of the Invention

This invention relates to a differential signal cable and a production method therefor.

2. Description of the Related Art

In as high speed signal transmission as a few Gbps or higher, differential signaling using a differential signal cable has been used. In the differential signaling, signal transmission and reception is performed by transmitting 180 degrees out of phase differential signals to two paired inner conductors respectively at a transmitting end, and taking a difference between the two signals received at a receiving end.

The differential signal cable at least includes the two inner conductors, an insulator, which covers the two inner conductors separately or together, and an outer conductor, which is provided in such a manner as to cover a circumference of the insulator.

Now, currents flowing in the two inner conductors of the differential signal cable can be decomposed into a differential mode, in which the signals are 180 degrees out of phase, and a common mode, in which the signals are in phase.

Because in the ideal differential signaling, the differential mode is input at the transmitting end, and is detected at the receiving end, the differential signal cable is required to minimize a quantity of energy conversion, in other words, mode conversion from the differential mode to the common mode in signal propagation from the transmitting end to the receiving end.

However, in the practical differential signal cable, it is known that the unintended mode conversion occurs due to a difference in length between the two inner conductors, a difference between signal propagation velocities in the two inner conductors, etc.

Such a mode conversion is considered to be caused by a difference between times taken by the signals to propagate in the two inner conductors, in other words, a skew. For that reason, for the differential signal cable for as relatively low speed transmission as lower than a few Gbps, the skew in step response waveform has been measured as a quantitative measure of the mode conversion by using a time domain reflectometer (TDR).

The skew of the differential signal cable is represented by the following formula.

$$\text{Skew [ps]} = t(P) - t(N)$$

$$= \Delta S / c \times \underline{\varepsilon_{eff}^{1/2}} + \underline{S} / c \times \Delta(\varepsilon_{eff}^{1/2})$$

Here, t(P), t(N): the propagation times in the inner conductors respectively

ΔS: the difference in length between the inner conductors c: the speed of light in vacuum S: the average value of the lengths of the inner conductors $$\underline{\epsilon_{eff}^{1/2}} = (\epsilon_{eff}^{1/2}(P) + \epsilon_{eff}^{1/2}(N))/2$$

$$\Delta(\epsilon_{eff}^{1/2}) = \epsilon_{eff}^{1/2}(P) - \epsilon_{eff}^{1/2}(N)$$

$\epsilon_{eff}^{1/2}(P)$, $\epsilon_{eff}^{1/2}(N)$: the respective single-ended effectiveness dielectric constants of the inner conductors.

Thus, reducing the difference ΔS in length between the inner conductors and the difference $\Delta(\epsilon_{eff}^{1/2})$ in square root of the effectiveness dielectric constant between the inner conductors allows for reducing the skew and suppressing the mode conversion.

On the other hand, for the differential signal cable for as high speed transmission as a few Gbps or higher, the skew cannot precisely be evaluated with the TDR, and therefore an SCD21 (dB), which is one component of a mixed S parameter, has been used as the quantitative measure of the mode conversion.

The SCD21 is for directly expressing the quantity of energy conversion from the differential mode to the common mode in the signal propagation from the transmitting end to the receiving end, and is typically measured in a frequency region to be used using a network analyzer for high frequency measurement. The SCD21 can be made small by making ΔS and $\Delta(\epsilon_{eff}^{1/2})$ small.

Note that as prior art publication information associated with the invention of this application, there are the following.

Refer to JP-A-2013-157309 and C. Paul, "Introduction to Electromagnetic Compatibility," WILEY-INTERSCIENCE, A JOHN WILEY & SONS, INC. PUBLICATION, December 2005, for example.

SUMMARY OF THE INVENTION

However, in the differential signal cable for as high speed transmission as a few Gbps or higher, there is the following problem: there is a limit on stably reducing the difference $\Delta(\epsilon_{eff}^{1/2})$in square root of the effectiveness dielectric constant between the inner conductors.

The respective effectiveness dielectric constants $\epsilon_{eff}^{1/2}(P)$ and $\epsilon_{eff}^{1/2}(N)$ of the inner conductors are values to be determined by a dielectric constant of the insulator around a circumference of the inner conductors and a locational relationship between the inner conductors and the outer conductor which acts as a reference of electric potential of the inner conductors. Therefore, for example, the transverse shift (decentering) of the inner conductors is large due to locational misalignment thereof when set in production equipment, or the difference $\Delta(\epsilon_{eff}^{1/2})$ in square root of the effectiveness dielectric constant between the inner conductors is large due to non-uniformity of the dielectric constant of the insulator.

It is virtually impossible to produce the differential signal cable with its inner conductors being not decentering, with its shape being completely symmetric, and with its insulator having a completely uniform dielectric constant. Even when the inner conductors are decentering, the cable shape is not symmetric, and the dielectric constant of the insulator is non-uniform, it is desired to reduce the SCD21 and suppress the mode conversion.

Accordingly, it is an object of the present invention to provide a differential signal cable, which obviates the above problem and which is capable of suppressing mode conversion, and a production method for that differential signal cable.

(1) According to one embodiment of the invention, a differential signal cable comprises:

two inner conductors;

an insulator, which covers the two inner conductors separately or together; and an outer conductor, which covers a circumference of the insulator, wherein when measured in a cable length of 1 m, an effective capacitance difference ΔX represented by Formula (1) below is not greater than 0.2 percent of an average value C of capacitances of the two inner conductors, $$\Delta X=\Delta C+\Delta L/Z_0^2 \quad (1),$$

where ΔC is a difference in capacitance between the two inner conductors, ΔL, is a difference in inductance between the two inner conductors, and $Z_0$ is a reference impedance (50 ohms).

In one embodiment, the following modifications and changes can be made.

(i) The outer conductor is being formed by longitudinally wrapping a metallic tape around an outer circumference of the insulator.

(ii) The difference ΔC in capacitance between the two inner conductors is not smaller than 0.2 percent of the average value C of the capacitances of the two inner conductors.

(iii) The insulator is made of a foamed insulator.

(iv) The difference ΔL in inductance between the two inner conductors is not smaller than 0.2 percent of the average value C of the capacitances of the two inner conductors.

(2) According to another embodiment of the invention, a method for producing a differential signal cable composed of two inner conductors, an insulator, which covers those two inner conductors separately or together, and an outer conductor, which covers a circumference of that insulator, comprises:

adjusting one or both of a difference in capacitance between the two inner conductors and a difference in inductance between the two inner conductors, so that, when measured in a cable length of 1 m, an effective capacitance difference ΔX represented by Formula (1) below is not greater than 0.2 percent of an average value C of capacitances of the two inner conductors, $$\Delta X=\Delta C+\Delta L/Z_0^2 \quad (1),$$

where ΔC is the difference in capacitance between the two inner conductors, ΔL is the difference in inductance between the two inner conductors, and $Z_0$ is a reference impedance (50 ohms).

In another embodiment, the following modifications and changes can be made.

(i) The differential signal cable production method further comprises adjusting locations of the two inner conductors so that the effective capacitance difference ΔX is not greater than 0.2 percent of the average value C of the capacitances of the two inner conductors, (ii) The differential signal cable production method further comprises adjusting a dielectric constant distribution in the insulator so that the effective capacitance difference ΔX is not greater than 0.2 percent of the average value C of the capacitances of the two inner conductors.

(iii) The differential signal cable production method further comprises forming a hole in the outer conductor so that the effective capacitance difference ΔX is not greater than 0.2 percent of the average value C of the capacitances of the two inner conductors.

(Points of the Invention)

According to the present invention, it is possible to provide the differential signal cable, which is capable of suppressing mode conversion, and the production method for that differential signal cable.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Below is described an embodiment according to the invention, in conjunction with the accompanying drawings.

Figure 1A:
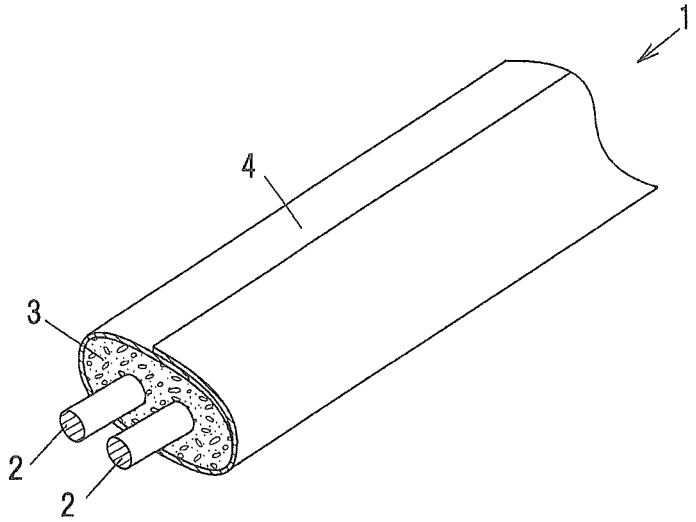
FIG. 1A is a perspective view showing a differential signal cable in the present embodiment.
Figure 1B:
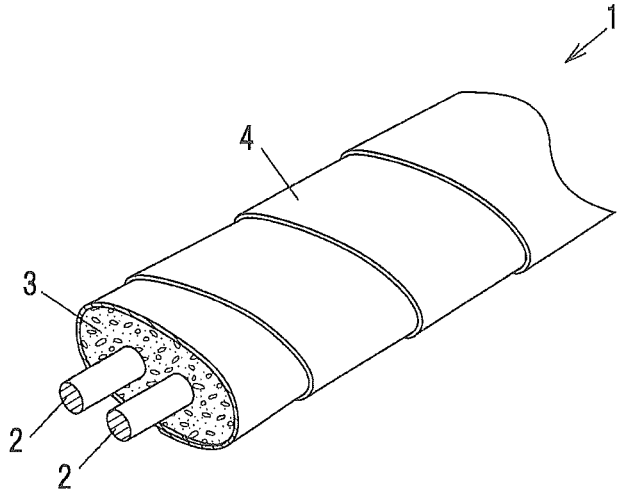
FIG. 1B is a perspective view showing a variation of a differential signal cable in the present embodiment.

FIG. 1A is a perspective view showing a differential signal cable 1 in the present embodiment. FIG. 1B is a perspective view showing a variation of a differential signal cable in the present embodiment.

As shown in FIG. 1A, the differential signal cable 1 is composed of two inner conductors 2, an insulator 3, which covers the two inner conductors 2 together, and an outer conductor 4, which covers a circumference of the insulator 3.

The two inner conductors 2 are arranged substantially parallel to each other. The insulator 3 may use either of a foamed insulator and a non-foamed insulator. FIG. 1A shows the foamed insulator is used as the insulator 3. The insulator 3 is formed in a substantially elliptic shape in cross sectional view. Note that although in the present embodiment the insulator 3 is formed in such a manner as to cover the two inner conductors 2 together, the insulator 3 may be formed in such a manner as to cover the two inner conductors 2 separately.

The outer conductor 4 is formed by wrapping around a circumference of the insulator 3 a metallic tape, which is formed with a metal layer over one side of a resin tape. Although in this embodiment, the outer conductor 4 is formed by longitudinally wrapping the metallic tape around the circumference of the insulator 3 as shown in FIG. 1A, the outer conductor 4 may be formed by helically wrapping the metallic tape around the circumference of the insulator 3 as shown in FIG. 1B.

Note that helically wrapping the metallic tape to form the outer conductor 4 allows a common mode (in-phase) signal to be attenuated, but in a high frequency region, a phenomenon called a suck out, which is an increase in loss at a particular frequency, occurs. For that reason, as the outer conductor 4, it is desirable to use the longitudinally wrapped metallic tape.

Although the outer conductor 4 using the longitudinally wrapped metallic tape lessens the attenuation of the common mode signal as compared with when the metallic tape is helically wrapped, there is no problem because the differential signal cable 1 allows for suppressing mode conversion and suppressing the occurrence itself of the common mode signal. In other words, the present invention is particularly effective in the differential signal cable 1 using the longitudinally wrapped metallic tape as the outer conductor 4 in order to suppress the suck out.

Although not shown, a further insulating layer may be formed by wrapping a resin tape around a circumference of the outer conductor 4. Also, an inner skin layer may be provided between the inner conductors 2 and the insulator 3, or an outer skin layer may be provided between the insulator 3 and the outer conductor 4.

Now, the differential signal cable 1 in the present embodiment, when measured in a cable length of 1 m, has an effective capacitance difference ΔX represented by Formula (1) below of not greater than 0.2 percent of an average value C of capacitances of the two inner conductors, $$\Delta X=\Delta C+\Delta L/Z_0^2 \quad (1),$$

where ΔC is a difference in capacitance between the two inner conductors, ΔL is a difference in inductance between the two inner conductors, and $Z_0$ is a reference impedance (50 ohms).

A reason therefor is described below.

Figure 1C:
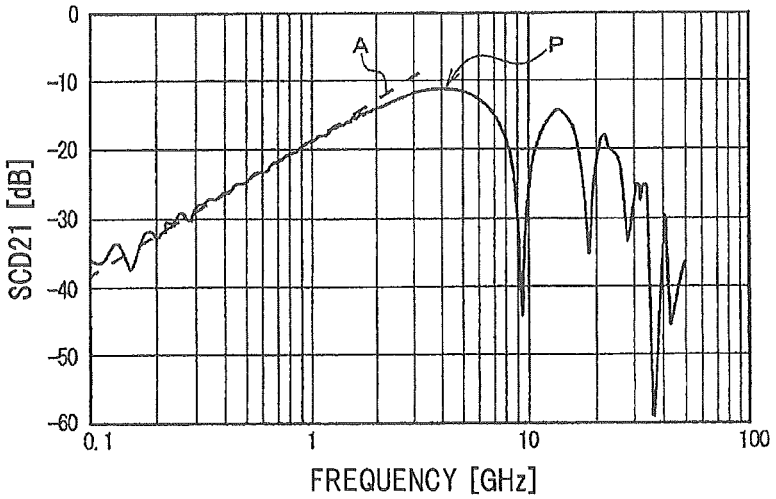
FIG. 1C is a graph chart showing a frequency property of SCD21.

As a result of an inventors' theoretical study on a frequency property of SCD21, it has been found that, as shown in FIG. 1C, in a low frequency region where the SCD21 exceeds −20dB, the frequency property of the SCD21 always has a constant peak shape.

More specifically, it has been found that the frequency property of the SCD21 may, in the low frequency region, be approximated by an approximate straight line A indicated by the broken line in FIG. 1C, and that the worst value of the SCD21 is often determined at a first peak P in the low frequency side.

Accordingly, the inventors have found from a further theoretical study that the approximate straight line A in the low frequency region is represented by Formula (2) below:

$$SCD21=20\log_{10}f_0+20\log_{10}|(\pi Z_0/2)\cdot\Delta X| \quad (2),$$

where $f_0$ is the frequency, $Z_0$ is the reference impedance (50 ohms), and ΔX is the effective capacitance difference: The effective capacitance difference ΔX in Formula (2) is represented by Formula (1) above, and represents a degree of electrical unbalance between the two inner conductors 2. Also, the reference impedance $Z_0$ is used to define the S parameter, and herein is set at 50 ohms. Also, the frequency $f_0$ is a frequency at which the frequency property of the SCD21 is regarded as being approximately linear on the double logarithmic graph of FIG. 1B, and may be set at not greater than (0.3/S) GHz where S is the cable length.

The intercept of the approximate straight line A in the low frequency region is determined by the second term of Formula (2), and reducing that second term value, i.e., the effective capacitance difference ΔX results in a decrease in the first peak P in the low frequency side, allowing for reducing maxima of the SCD21 over the entire frequency region.

Accordingly, the inventors, in practice, experimentally produced a large number of the differential signal cables 1, measured the SCD21 and the effective capacitance difference ΔX and found the relationship between the SCD21 and the effective capacitance difference ΔX. The cable length to be measured was set at 1 m, and the SCD21 was measured with a network analyzer. Also, the effective capacitance difference ΔX was obtained from Formula (1) above by measuring the difference ΔC in capacitance (self-capacitance) between the two inner conductors 2 and the difference ΔL in inductance (self-inductance) between the two inner conductors 2. The measurement of the SCD21 and the effective capacitance difference ΔX was performed in two frequency bands of 7 GHz or lower and 50 GHz or lower.

Figure 2:
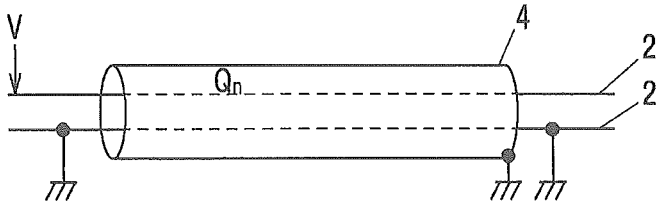
FIG. 2 is an explanatory diagram showing a method to measure a capacitance of the inner conductors in the present invention.

Note that the difference ΔC in capacitance between the two inner conductors 2 may be obtained by measuring the respective capacitances (i.e., respective sums of respective self-capacitances and mutual capacitance) of both the inner conductors 2 and taking the difference therebetween. When as shown in FIG. 2, one of the inner conductors 2 and the outer conductor 4 are grounded and a voltage of V is applied to the other of the inner conductors 2 and there is an electric charge of Qn on the other inner conductor 2, the capacitance Cn' of the other inner conductor 2 can be obtained from Formula (3) below.

$$Cn'=Cn+Cpn=Qn/V \quad (3)$$

Similarly, the capacitance Cp' of the one inner conductor 2 is obtained from Formula (4) below.

$$Cp'=Cp+Cpn=Qp/V \quad (4)$$

The difference ΔC in capacitance between the two inner conductors 2 (herein referred to as the capacitance difference ΔC) can be obtained by taking the difference between Cn' in eq. (3) and Cp' in eq. (4): ΔC=Cn'−Cp'=Cn−Cp. Also, by taking the average of both the capacitances Cn' and Cp', the average value C (=(Cn'+Cp')/2) of the capacitances of the two inner conductors 2 can be obtained.

The difference ΔL in inductance between the two inner conductors 2 (herein referred to as the inductance difference ΔL) can be calculated from a cross sectional shape of the differential signal cable 1, which is detected by using a microscope, an X-ray CT, etc. This is because the inductance difference ΔL is the property which is not affected by dielectric constant distribution, but determined by only the arrangement and shape of the conductors. For this reason, for the differential signal cable 1, center locations and diameters of the inner conductors 2 and inner surface shape of the outer conductor 4 are measured so that the inductance difference ΔL can be calculated from Maxwell equations with numerical analysis methods such as a finite element method, a finite difference method, a moment method, etc. The calculation method for the inductance of the cable is described in detail in C. Paul, "Introduction to Electromagnetic Compatibility," WILEY-INTERSCIENCE, A JOHN WILEY & SONS, INC. PUBLICATION, December 2005, for example.

Figure 1D:
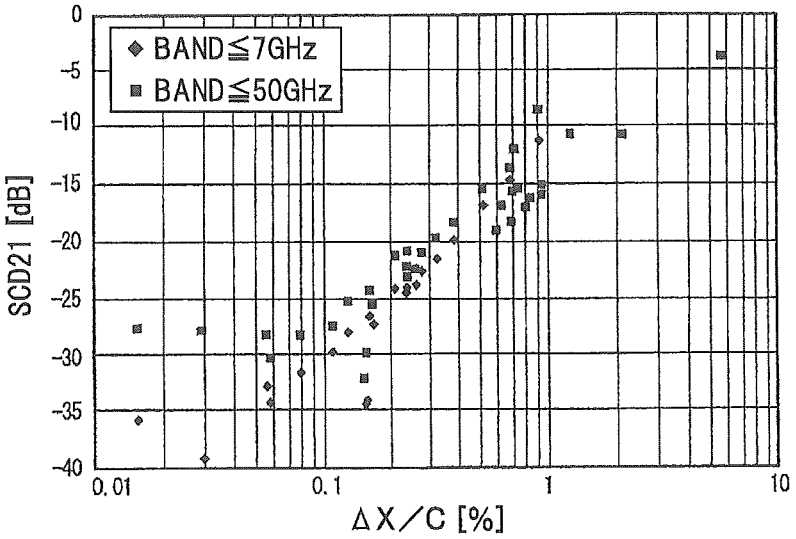
FIG. 1D is a graph chart showing the actual measured value of SCD21 versus the value of an effective capacitance difference ΔX divided by an average value C of capacitances of two inner conductors.

Measured results thereof are shown in FIG. 1D. Note that, in FIG. 1D, the horizontal axis is ΔX/C, which is the value of the effective capacitance difference ΔX divided by the average value C of the capacitances of the two inner conductors 2.

As shown in FIG. 1D, although there is some variation due to measurement errors, etc., there is the correlation between the SCD21 and the effective capacitance difference ΔX (herein ΔX/C) in the two frequency bands.

The differential signal cable 1 for high speed transmission is required to make its practical SCD21 smaller than −20 dB. It is seen from FIG. 1D that making ΔX/C not greater than 0.2 percent securely allows the SCD21 to be smaller than −20 dB, even taking account of its variation.

In other words, the differential signal cable 1 in the present embodiment is designed to make its effective capacitance difference ΔX not greater than 0.2 percent of the average value C (herein referred to as C×0.2 percent) of the capacitances of its two inner conductors 2, and thereby set its SCD21 at the value of smaller than −20 dB so that the mode conversion can be suppressed with no practical problem.

From this, the SCD21 can be made smaller than −20 dB by adjusting one or both of the capacitance difference ΔC and the inductance difference ΔL in such a manner as to make the effective capacitance difference ΔX not greater than C×0.2 percent, but even without setting the capacitance difference ΔC and the inductance difference ΔL at the ideal value of zero.

Figure 3A:
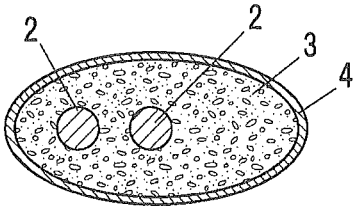
FIGS. 3A-3E are explanatory diagrams showing occurrence factors, respectively, of a capacitance difference ΔC and an inductance difference ΔL in the present invention.
Figure 3D:
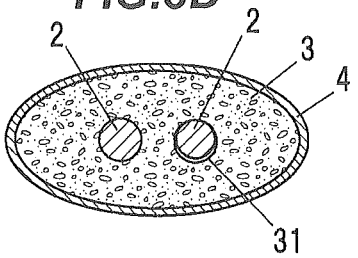
Figure 3B:
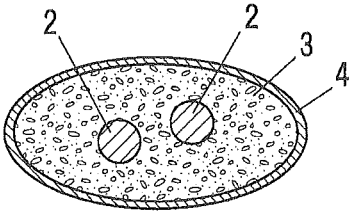
Figure 3E:
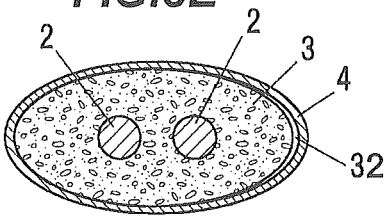
Figure 3C:
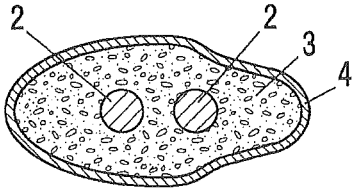

As occurrence factors of the capacitance difference ΔC and the inductance difference ΔL, there are listed the following: locational misalignment (decentering) of the inner conductors 2 as shown in FIG. 3A and FIG. 3B, deformation of the insulator 3 as shown in FIG. 3C, occurrence of a void 31 around a circumference of the inner conductors 2 as shown in FIG. 3D, occurrence of a void 32 between the insulator 3 and the outer conductor 4 as shown in FIG. 3E, variation in the degree of foaming of a foamed insulator used as the insulator 3 or variation in the thickness of a skin layer provided as the insulator 3, and the like.

Although no existing technique can completely exclude those occurrence factors, the SCD21 can be suppressed in the practical range by adjusting one or both of the capacitance difference ΔC and the inductance difference ΔL in such a manner as to make the effective capacitance difference ΔX not greater than C×0.2 percent.

More specifically, the inductance difference ΔL is a parameter to be determined mainly by the locational misalignment of the inner conductors 2 and the shape distortion of the insulator 3. Also, the capacitance difference ΔC is a parameter to be determined by the non-uniformity of the dielectric constant distribution in the insulator 3 and the shape distortion of the insulator 3. Thus, when the capacitance difference ΔC is large, the inner conductors 2 may deliberately be rendered decentering to introduce the inductance difference ΔL to cancel out the capacitance difference ΔC to make the effective capacitance difference ΔX not greater than C×0.2 percent. Also, when the inductance difference ΔL is large, the dielectric constant distribution in the insulator 3 may deliberately be rendered non-uniform to introduce the capacitance difference ΔC to cancel out the inductance difference ΔL to make the effective capacitance difference ΔX not greater than C×0.2 percent.

The differential signal cable 1 may have its capacitance difference ΔC of not less than C×0.2 percent. If the capacitance difference ΔC is solely not less than C×0.2 percent due to use of a foamed insulator as the insulator 3, no conventional method can make the SCD21 smaller than −20 dB. However, the SCD21 can be made small by adjusting locations of the inner conductors 2 to adjust the inductance difference ΔL to cancel out the capacitance difference ΔC to make the effective capacitance difference ΔX not greater than C×0.2 percent.

Also, the differential signal cable 1 may have its inductance difference ΔL of not less than C×0.2 percent. If the inductance difference ΔL is solely not less than C×0.2 percent due to the locational misalignment of the inner conductors 2 when set in production equipment, no conventional method can make the SCD21 smaller than −20 dB. However, the SCD21 can be made small by deliberately rendering the dielectric constant distribution non-uniform to adjust the capacitance difference ΔC to cancel out the inductance difference ΔL to make the effective capacitance difference ΔX not greater than C×0.2 percent.

Note that, in the present embodiment, the effective capacitance difference ΔX when measured in a cable length of 1 m is specified. A reason for specifying the cable length in that measurement is because if the cable length is long, the SCD21 becomes small due to the attenuation of the common mode signal and it is deduced by inverse calculation from Formula (2) above that the apparent effective capacitance difference ΔX is small. The differential signal cable 1 in the present embodiment, even when measured in any portion thereof in its longitudinal direction, has the effective capacitance difference ΔX of not greater than C×0.2 percent when measured in the cable length of 1 m.

A production method for the differential signal cable in the present embodiment is designed to adjust one or both of the capacitance difference ΔC and the inductance difference ΔL so that the effective capacitance difference ΔX, when measured in the cable length of 1 m, is not greater than C×0.2 percent, The production method for the differential signal cable in the present embodiment is designed to measure the capacitance difference ΔC and the inductance difference ΔL at the time of production and adjust both of them so that the effective capacitance difference ΔX is not greater than C×0.2 percent.

As described above, because the inductance difference ΔL is greatly affected by the locational misalignment of the inner conductors 2, locations of the inner conductors 2 may be adjusted to adjust the inductance difference ΔL. Note that the method to adjust the inductance difference ΔL is not limited thereto.

Also, because the capacitance difference ΔC is greatly affected by the dielectric constant distribution in the insulator 3, the dielectric constant distribution in the insulator 3 may be adjusted to adjust the capacitance difference ΔC. Note that the method to adjust the capacitance difference ΔC is not limited thereto.

The production method for the differential signal cable in the present embodiment is especially effective when the insulator 3 is a foamed insulator. In the foamed insulator, the capacitance difference ΔC is likely to be greater than C×0.2 percent due to the asymmetry of the distribution of the degree of foaming in the insulator 3. In that case, the effective capacitance difference ΔX may be adjusted to not greater than C×0.2 percent by deliberately rendering the locations of the inner conductors 2 asymmetric so that the capacitance difference ΔC caused by the asymmetry of the distribution of the degree of foaming is cancelled out by the inductance difference ΔL and the capacitance difference ΔC caused by the locational misalignment of the inner conductors 2. Note that because the present invention is directed to adjusting the effective capacitance difference ΔX to not greater than C×0.2 percent, the method to adjust the capacitance difference ΔC and the inductance difference ΔL is not limited thereto.

Figure 4:
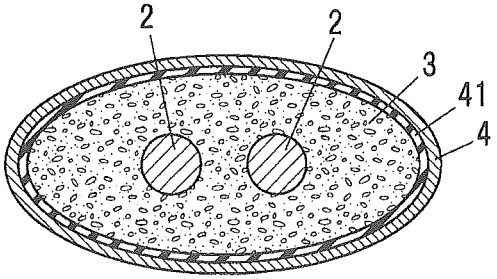
FIG. 4 is a transverse cross sectional view showing one modification of the differential signal cable in the present embodiment of the invention.

Also, when the insulator 3 is a foamed insulator, the insulator 3 may be structured to cover that foamed insulator with a non-foamed skin layer 41 as shown in FIG. 4 so as to prevent moisture ingress into that foamed insulator layer. In that case, the capacitance difference ×C is likely to be greater than C×0.2 percent due to the asymmetry of the thickness of the non-foamed skin layer 41. Even in that case, the effective capacitance difference ΔX may be adjusted to not greater than C×0.2 percent by deliberately rendering the locations of the inner conductors 2 asymmetric so that the capacitance difference ΔC and the inductance difference ΔL caused by the asymmetry of the thickness of the non-foamed skin layer 41 are cancelled out by the capacitance difference ΔC and the inductance difference ΔL caused by the locational misalignment of the inner conductors 2. Note that because the present invention is directed to adjusting the effective capacitance difference ΔX to not greater than C×0.2 percent, the method to adjust the capacitance difference ΔC and the inductance difference ΔL is not limited thereto.

As described above, the differential signal cable 1 in the present embodiment is configured to have the effective capacitance difference ΔX of not greater than 0.2 percent of the average value C of the capacitances of its two inner conductors 2 when measured in the cable length of 1 m.

This configuration, even when the difference in effective dielectric constant between the inner conductors 2 is large, allows the mode conversion to be suppressed by adjusting the capacitance difference ΔC and/or the inductance difference ΔL in such a manner as to reduce the SCD21. It is therefore possible to suppress the effect of the difference in effective dielectric constant between the inner conductors 2 on the differential signal attenuation, but at the same time, increase the common mode signal attenuation.

The invention is not limited to the above described embodiment, but various alterations may naturally be made without departing from the spirit and scope of the invention.

For example, although not mentioned in the above described embodiment, the SCD21 reducing effect can be made larger by adding a further configuration to attenuate the common mode signal.

The configuration to attenuate the common mode signal may be used by, for example, being provided with openings (holes) aligned in the longitudinal direction on the outer conductor located equidistant from the two inner conductors 2. In order to increase the attenuation of the common mode signal, it is desirable to disturb current distribution of the common mode signal as much as possible to thereby increase reflection and mode conversion of the common mode signal. The reflectance of the common mode signal may be increased by periodically arranging the openings in the longitudinal direction. Note that the quantity of the mode conversion of the common mode signal may be increased by displacing the openings from their locations equidistant from the two inner conductors 2. The period and shape of the openings may not be fixed, but be adjusted appropriately according to a frequency of the common mode signal desired to be removed.

Also, although in the above described embodiment, the method to find the capacitance difference ΔC and the inductance difference ΔL and thereby obtain from Formula (1) the effective capacitance difference ΔX has been described as one example, the method to obtain the effective capacitance difference ΔX is not limited thereto.

For example, Formula (2) may be rearranged as Formula (5) below:

$$|\Delta X|=(2/\pi Z_0)\times 10^{\wedge}\{(\mathrm{SCD21(dB)}-20\log_{10}f_0)/20\} \quad (5),$$

where $f_0$ is the frequency, $Z_0$ is the reference impedance (50 ohms), and SCD21 (dB) is the SCD21 value in dB ($Z_0$=50 ohms). Therefore, the effective capacitance difference ΔX may be deduced by measuring the S parameter (SCD21 (dB)) using a network analyzer, and performing arithmetic operations on the resulting measured data. At this point, when the outer conductor 4 using the longitudinally wrapped metallic tape is used, the frequency $f_0$may be set at not greater than (0.3/S) GHz where S is the cable length. Besides, with a method to convert the S parameter obtained by the measurement into an F parameter, the effective capacitance difference ΔX may be deduced. The methods to obtain the effective capacitance difference ΔX are optionally selectable. It should be noted, however, that although there are the plurality of methods to obtain the effective capacitance difference ΔX, the value of ΔX may slightly vary according to the measuring methods therefor, due to the influence of measurement errors, etc. In at least one of the measuring methods, the effective capacitance difference ΔX is set to be not greater than 0.2 percent of the average value C of the capacitances of the two inner conductors.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A differential signal cable, comprising:

two inner conductors;

an insulator, which covers the two inner conductors separately or together; and an outer conductor, which covers a circumference of the insulator, wherein when measured in a cable length of 1 m, an effective capacitance difference ΔX represented by Formula (1) below is not greater than 0.2 percent of an average value C of capacitances of the two inner conductors, $$\Delta X=\Delta C+\Delta L/Z_0^2 \quad (1),$$

where ΔC is a difference in capacitance between the two inner conductors, ΔL is a difference in inductance between the two inner conductors, and $Z_0$ is a reference impedance (50 ohms).

2. The differential signal cable according to claim 1, wherein the outer conductor is being formed by longitudinally wrapping a metallic tape around an outer circumference of the insulator.

3. The differential signal cable according to claim 2, wherein the difference ΔC in capacitance between the two inner conductors is not smaller than 0.2 percent of the average value C of the capacitances of the two inner conductors.

4. The differential signal cable according to claim 3, wherein the insulator is made of a foamed insulator.

5. The differential signal cable according to claim 4, wherein the difference ΔL in inductance between the two inner conductors is not smaller than 0.2 percent of the average value C of the capacitances of the two inner conductors.

6. A method for producing a differential signal cable composed of two inner conductors, an insulator, which covers those two inner conductors separately or together, and an outer conductor, which covers a circumference of that insulator, the method comprising:

adjusting one or both of a difference in capacitance between the two inner conductors and a difference in inductance between the two inner conductors, so that, when measured in a cable length of 1 m, an effective capacitance difference ΔX represented by Formula (1) below is not greater than 0.2 percent of an average value C of capacitances of the two inner conductors, $$\Delta X=\Delta C+\Delta L/Z_0^2 \quad (1),$$

where ΔC is the difference in capacitance between the two inner conductors, ΔL is the difference in inductance between the two inner conductors, and $Z_0$ is a reference impedance (50 ohms).

7. The differential signal cable production method according to claim 6, further comprising:

adjusting locations of the two inner conductors so that the effective capacitance difference ΔX is not greater than 0.2 percent of the average value C of the capacitances of the two inner conductors.

8. The differential signal cable production method according to claim 6, further comprising:

adjusting a dielectric constant distribution in the insulator so that the effective capacitance difference ΔX is not greater than 0,2 percent of the average value C of the capacitances of the two inner conductors.

* * * * *